United States Patent [19]

Lalvani

[11] Patent Number: 4,723,382

[45] Date of Patent: Feb. 9, 1988

[54] BUILDING STRUCTURES BASED ON POLYGONAL MEMBERS AND ICOSAHEDRAL

[76] Inventor: Haresh Lalvani, 91 Horatio St., New York, N.Y. 10014

[21] Appl. No.: 896,848

[22] Filed: Aug. 15, 1986

[51] Int. Cl.[4] ..... E04B 1/32

[52] U.S. Cl. ..... 52/81; 52/79.4; 52/648; 52/DIG. 10

[58] Field of Search ..... 52/DIG. 10, 81, 648, 52/79.4; 434/403; 273/157 R

[56] References Cited

U.S. PATENT DOCUMENTS

| | | | |
|---|---|---|---|
| 143,835 | 10/1873 | Muller . | |
| 3,461,574 | 8/1969 | Larsen | 434/403 |
| 3,600,825 | 8/1971 | Pearce . | |
| 3,637,217 | 1/1972 | Kent . | |
| 3,645,535 | 2/1972 | Randolph | 52/DIG. 10 |
| 3,659,360 | 5/1972 | Zeischegg | 52/DIG. 10 |
| 3,722,153 | 3/1973 | Baer | 52/DIG. 10 |
| 3,974,600 | 8/1976 | Pearce | 52/DIG. 10 |
| 4,113,256 | 9/1978 | Hutchings . | |
| 4,129,975 | 12/1978 | Gabriel . | |
| 4,133,152 | 1/1979 | Penrose . | |
| 4,183,190 | 1/1980 | Bance . | |
| 4,343,471 | 8/1982 | Calvert | 52/311 |

OTHER PUBLICATIONS

Zome Primer by Steve Baer ©1972.

P. Kramer, Non-Periodic Central Space Filing with Icosahedral Symmetry Using Copies of Seven Elementary Cells, *Acta. Cryst.* 1982 pp. 257-264.

R. Mosseri et al, Two and Three Dimensional Non-Periodic Networks Obtained from Self-Similar Tiling, *Structure of Non-Crystalline Materials* 1982, pp. 137-150.

*Primary Examiner*—Henry E. Raduazo

*Attorney, Agent, or Firm*—Roylance, Abrams, Berdo & Goodman

[57] ABSTRACT

Building structures based on polygonal members with coplanar straight edges and icosahedral symmetry. The building structures comprise a set of ten elementary polygonal members, including four triangular members and six parallelogram-shaped members, that are combined to form tetrahedral, octahedral and half-octahedral or trucated tetrahedral, cuboctahedral and truncated octahedral or rhombohedral and parallelpiped building members that in turn fill a three-dimensional space periodically or non-periodically. The orientation of the building members is such that all edges are parallel to the fifteen two-fold axes of rotation of icosahedral symmetry.

8 Claims, 54 Drawing Figures

FIG. 35
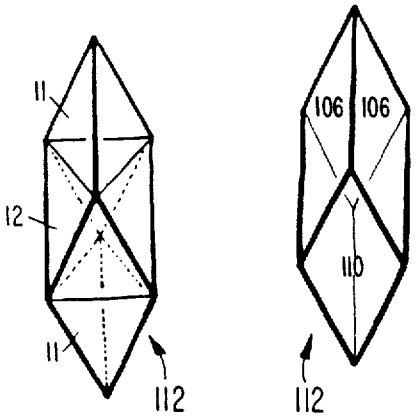
FIG. 36
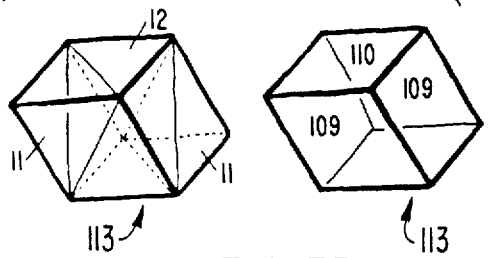
FIG. 37
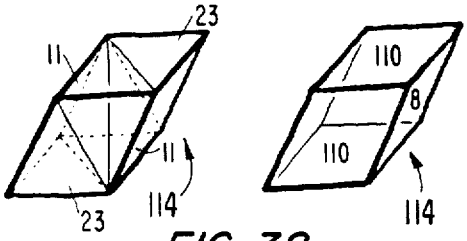
FIG. 38
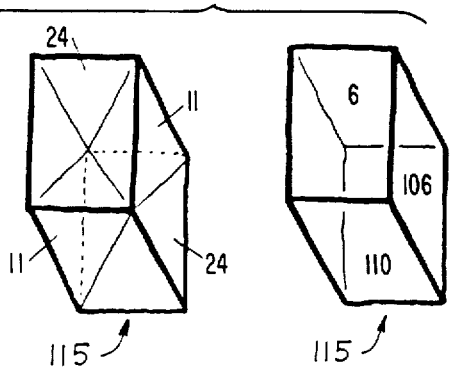
FIG. 39
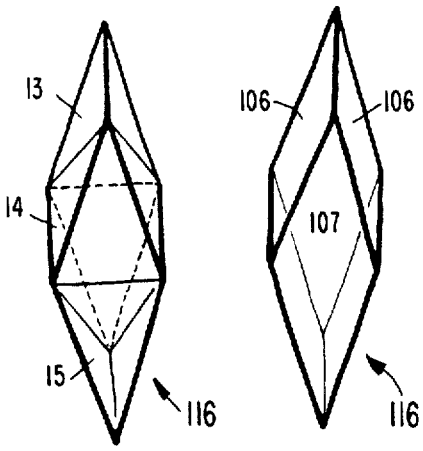
FIG. 40
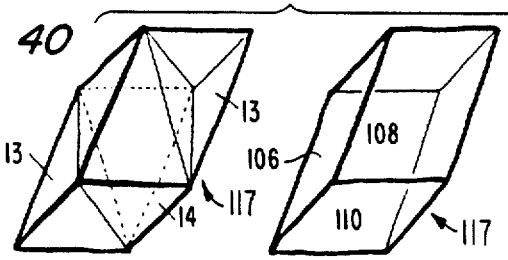
FIG. 41
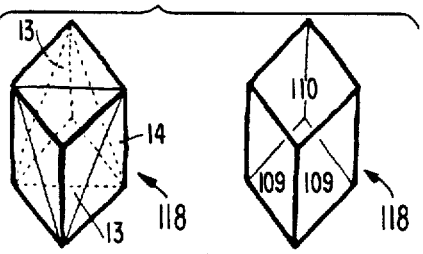
FIG. 42
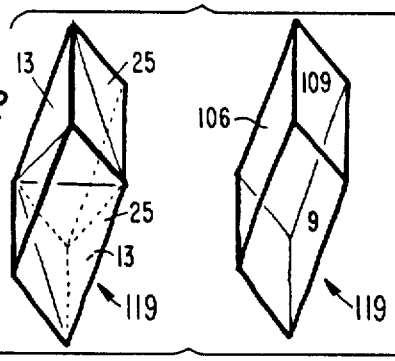
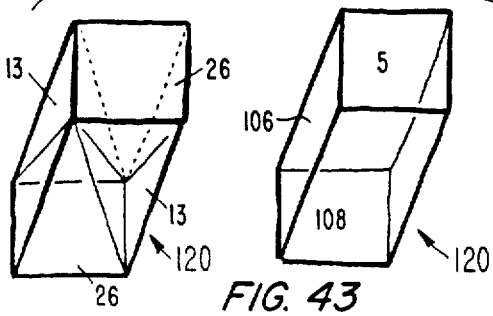
FIG. 43

BUILDING STRUCTURES BASED ON POLYGONAL MEMBERS AND ICOSAHEDRAL

FIELD OF THE INVENTION

The invention relates to building structures based on polygonal members and icosahedral symmetry. More particularly, the invention relates to a set of ten elementary polygonal members, including four triangular members and six parallelogram-shaped members, that are combined to form tetrahedral, octahedral and half-octahedral or truncated tetrahedral, cuboctahedral and truncated octahedral or rhombohedra and parallelopiped building members that in turn fill a three-dimensional space periodically or non-periodically.

BACKGROUND OF THE INVENTION

Several prior art systems are known providing for building structures using pentagonal, hexagonal, cubic and icosahedral symmetry.

In two-dimensions, U.S. Pat. Nos. 143,835 to Muller, 4,343,471 to Calvert, and 4,133,152 to Penrose demonstrate pentagonal symmetry. U.S. Pat. No. 3,637,217 to Kent demonstrates hexagonal symmetry.

In three-dimensions, U.S. Pat. Nos. 3,600,825 to Pearce, 4,129,975 to Gabriel, and 4,183,190 to Bance demonstrate cubic symmetry. U.S. Pat. Nos. 3,722,153 to Baer and 4,113,256 to Hutchings demonstrate icosahedral symmetry. The disclosures of these eight patents are hereby incorporated by reference.

In articles published by Kramer and by Mosseri and Sadoc, icosahedral symmetry is used to create building structures, with Kramer using seven elementary cells and Mosseri and Sadoc using four and six elementary cells.

However, none of these systems discloses or suggests breaking down a building structure to a versatile basic set of polygonal planar members which can be combined to form polyhedra that in turn are combined to fill three-dimensional space periodically or non-periodically.

SUMMARY OF THE INVENTION

The invention comprises a non-periodic building kit or system consisting of ten elementary polygons with edges in the golden ratio $\phi$ also known as the "golden mean" or "divine proportion," where $\phi=1$ plus the square root of 5 divided by $2=1.61803\ldots$, which is the ratio between the diagonal of a regular pentagon and its side. These elementary polygons combine with each other to produce 12 three-dimensional building blocks that fit tightly with one another to fill all space. The angles of the polygons are derived from 36°, 60°, 72° and 90°. The three-dimensional blocks are six complementary pairs of tetrahedra and octahedra. The octahedra can be bisected to produce 10 half-octahedra (pyramids), and all edges of these polyhedra are parallel to the 15 directions of the two-fold axes of icosahedral symmetry. These directions determine the permissible angles of polygons and their combinations. Though the blocks can fit together periodically, as in conventional building systems, the more unique aspect of this system is its ability to provide a large variety of non-periodic (i.e., non-repetitive, or more precisely, lacking in translational symmetry) space-filling arrangements.

Further, the 3-d blocks combine with one another in various ways to produce larger replicas of themselves. These replicas are $\phi$, $\phi^2$, $\phi^3$, $\phi^4$, . . . times the elementary modules, and since the increments in size are in incommensurate ratios of the golden mean series, the space-filling is necessarily non-periodic. In addition, the blocks pack together to produce seven polyhedra with regular faces (i.e., polygons with equal edges and angles) and having icosahedral symmetry. These include the two regular or Platonic solids, namely, the icosahedron and the dodecahedron, and five semi-regular or Archimedean polyhedra. Several star polyhedra are also possible. These polyhedra can act as larger modules in spatial arrangements.

The elementary polygons can also be combined to produced composite polygons. Six new rhombii and four hexagons are produced and in three-dimensions, composite polyhedra are produced. These include sets of rhombohedra, and six sets of affine (i.e., sheared) versions of the truncated tetrahedron, the cuboctahedron and the truncated octahedron. These composite polyhedra act as larger cells in space-fillings.

The non-periodic building kit can be used for interior and exterior architectural environments, toys and games, and for modular systems for a variety of functions. The kit can be converted into a space frame system by using a suitable "node", (a rhombic triacontahedron, for example), two types of "struts", for the two edge-lengths, and each polygon can become a "panel". Non-periodic structures are a marked departure from the periodic building systems commonly in use. Besides offering a large variety of new configurations, the non-repetitive aspects have a strong aesthetic appeal. The varying geometry provides the possibility to accommodate varying functional and formal aspects of design. The use of tetrahedra and octahedra provide all-triangulated systems, known for their advantage of structural stability. When used as 3-d modules, suitable attachment devices and color-coding between the parts can be designed to facilitate assembly.

DRAWINGS

Referring now to the drawings which form a part of this original disclosure:

Figure 1:
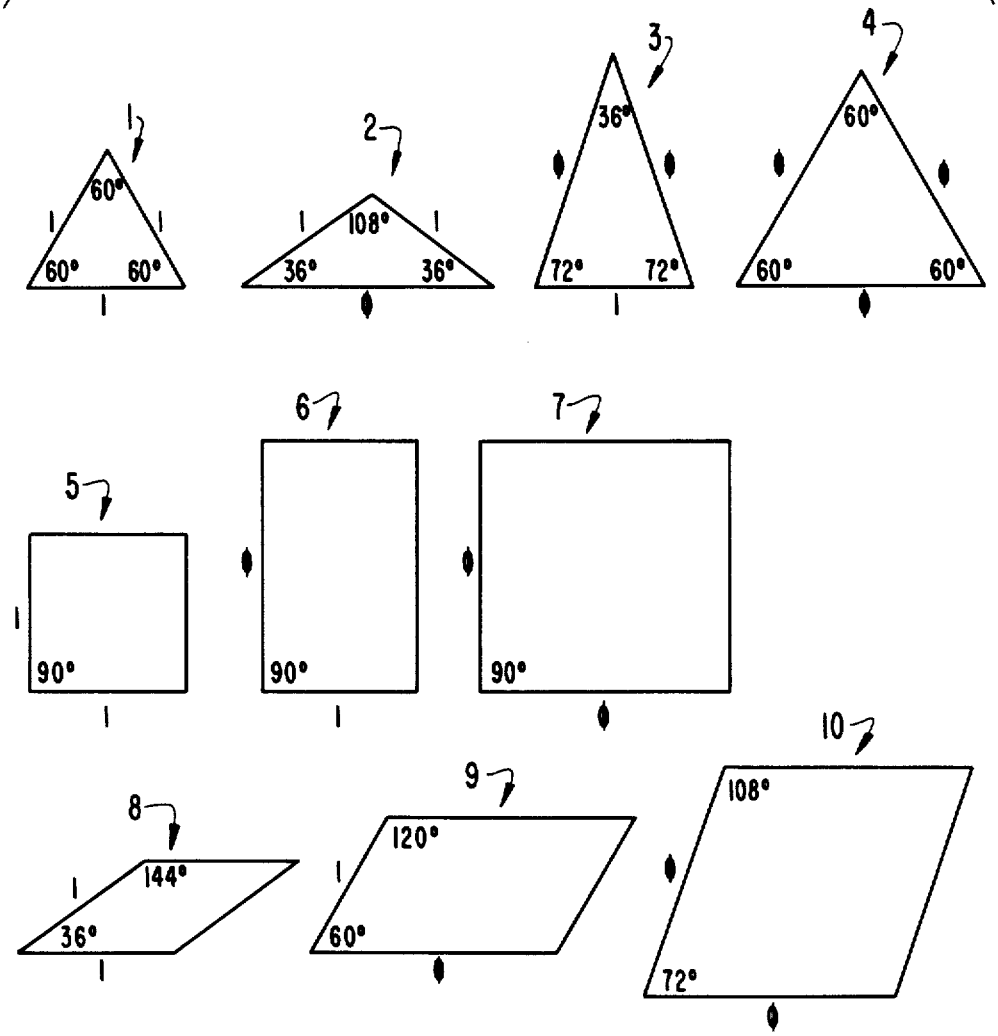
FIG. 1 is a front elevational view of the ten elementary polygonal members, each having coplanar straight edges and formed as a solid panel or a structure defined by the edges, and including four triangular-shaped members and six parallelogram-shaped members.
Figure 2:
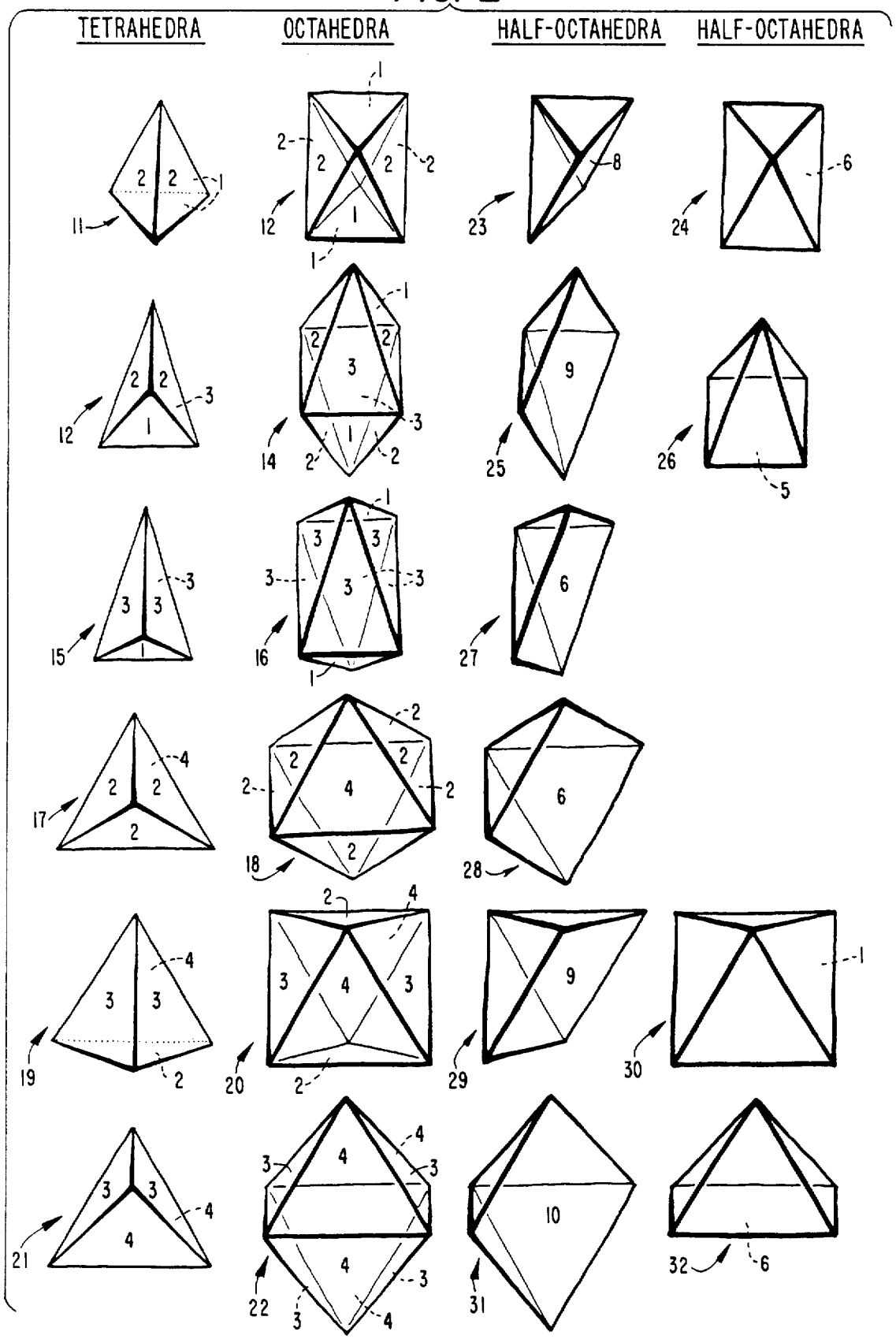
FIG. 2 is a front elevational view of the six pair of tetrahedra and octahedra formed by the polygons of FIG. 1, as well as the ten half-octahedra formed by bisecting the octahedra.
Figure 17:
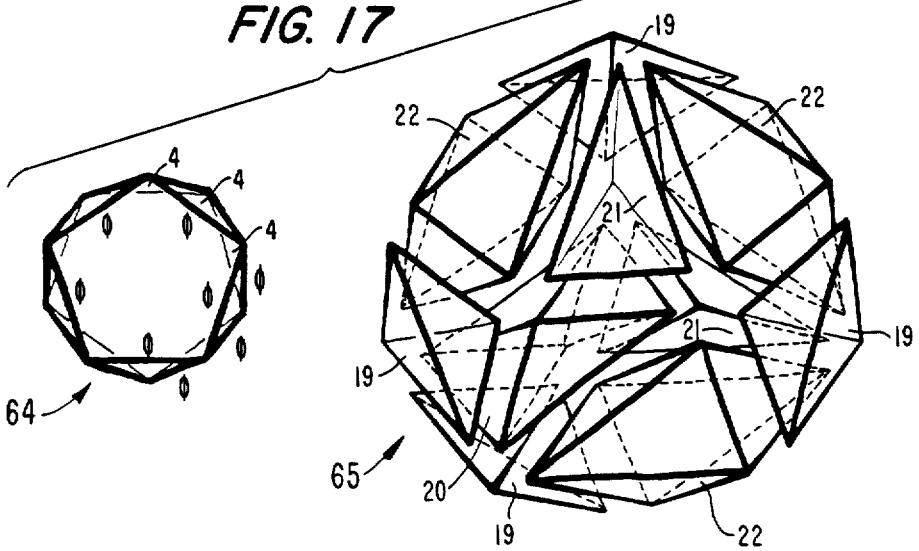
Figure 18:
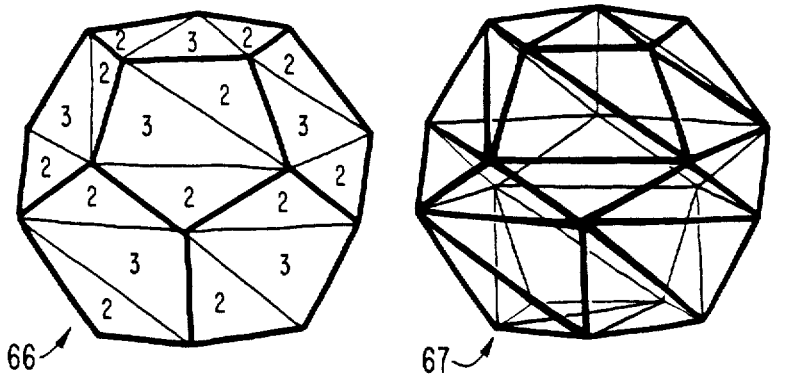
Figure 19:
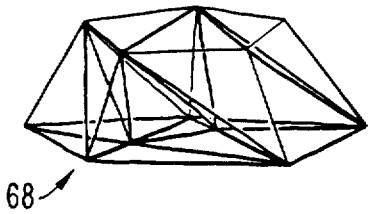
Figure 20:
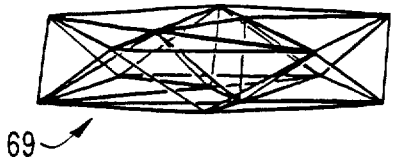
Figure 21:
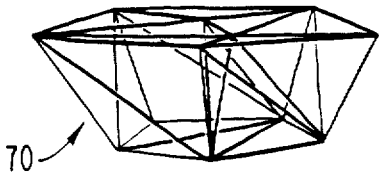
Figure 22:
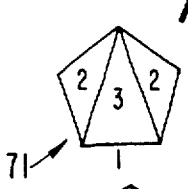
Figure 23:
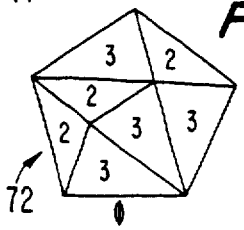
Figure 24:
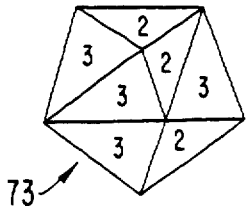
Figure 25:
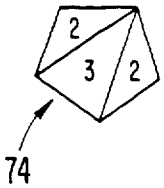
Figure 26:
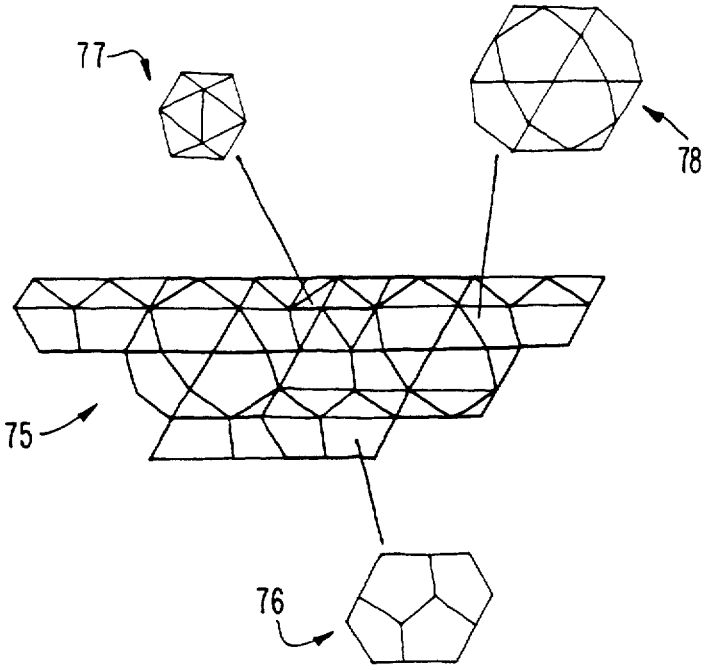
Figure 27:
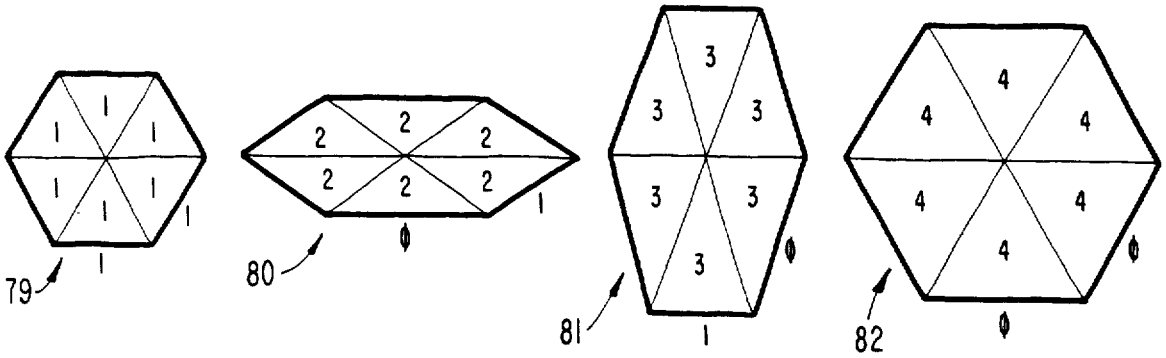
Figure 28:
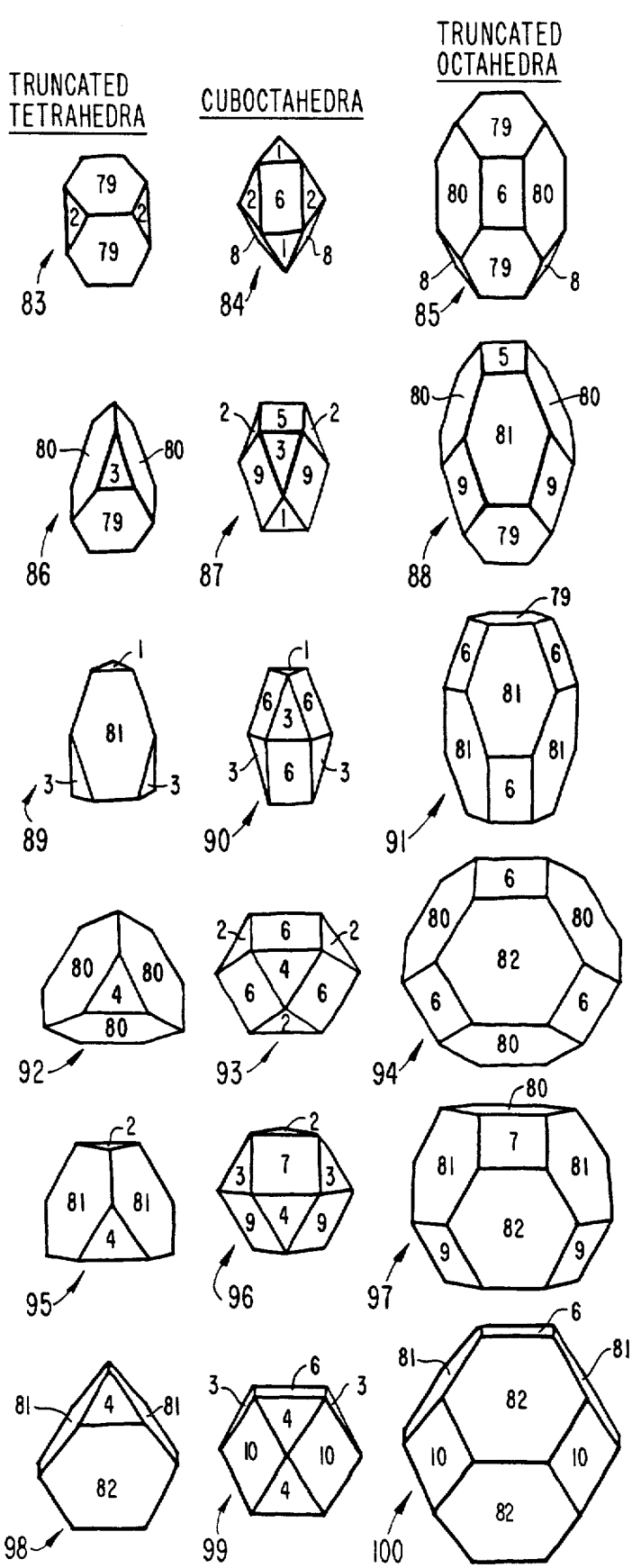
Figure 29:
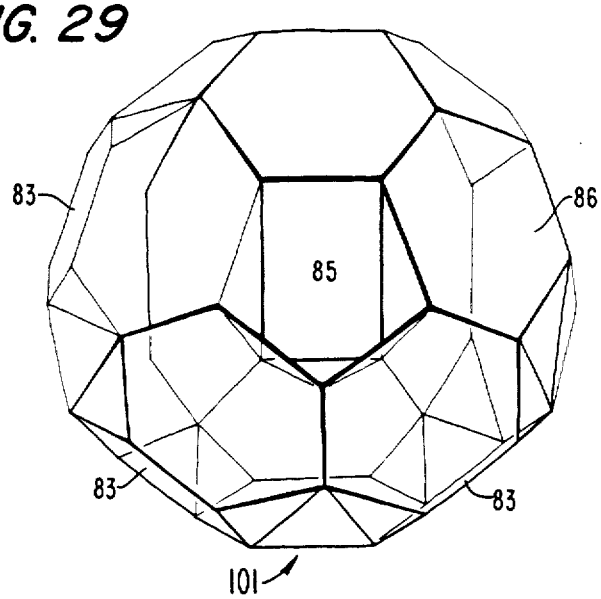
Figure 30:
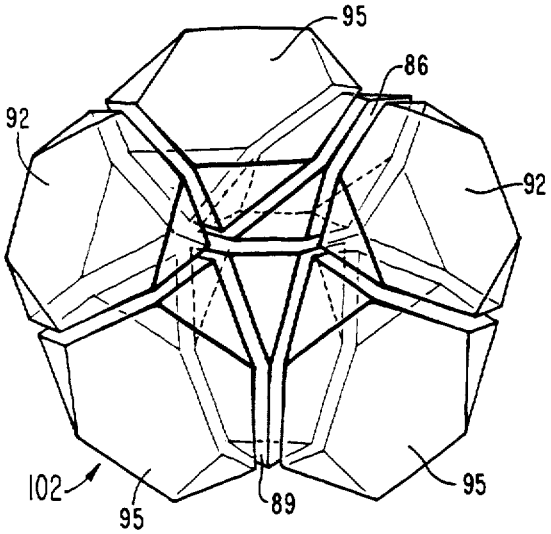
Figure 31:
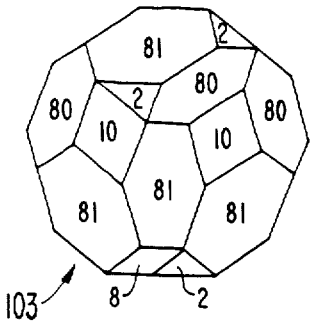
Figure 32:
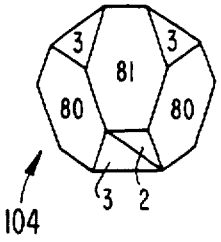
Figure 33:
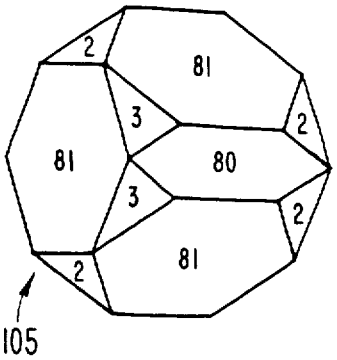
Figure 34:
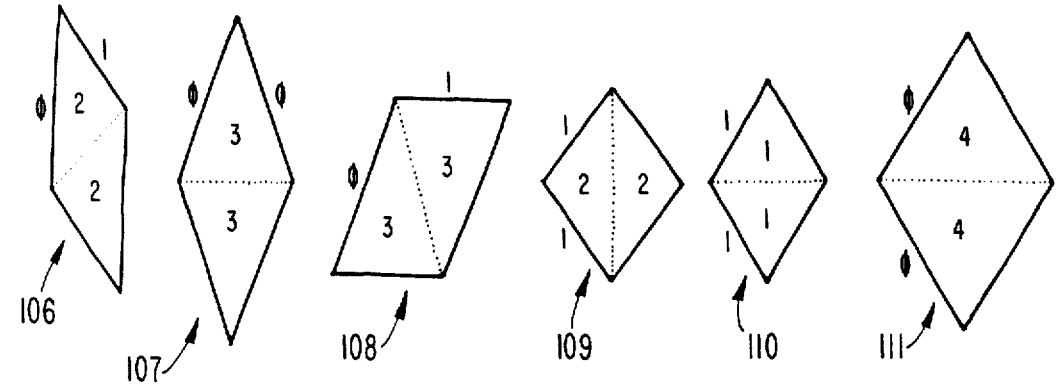
Figure 44:
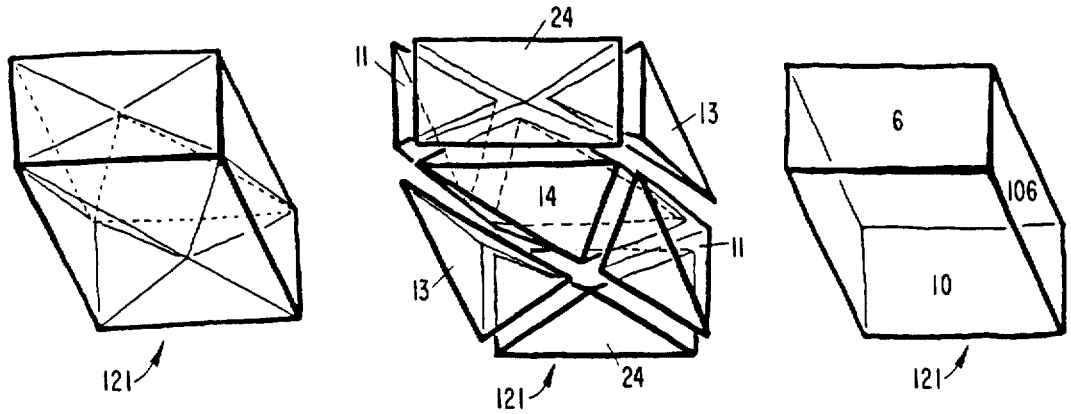
Figure 45:
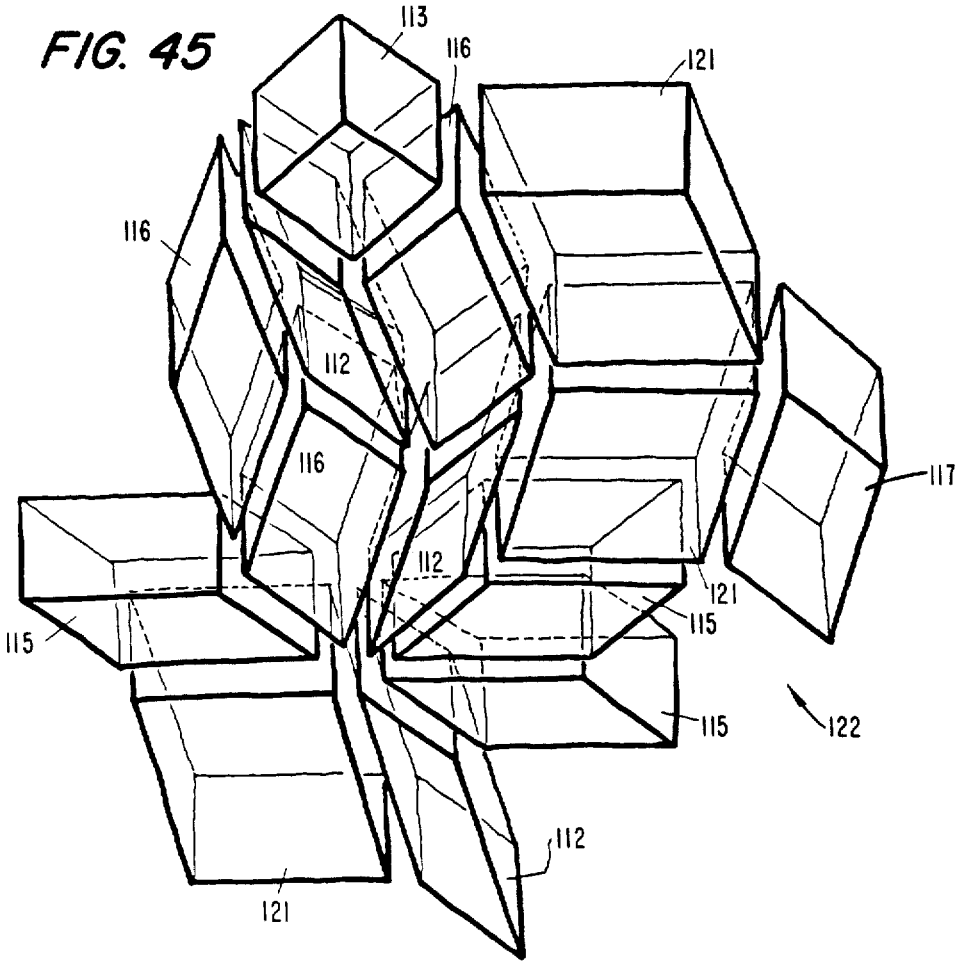
Figure 46:
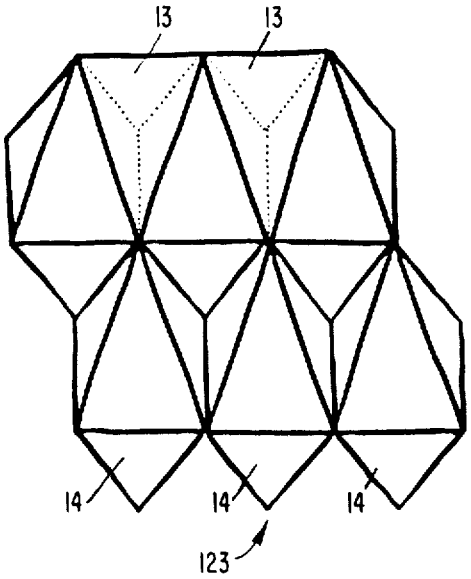
Figure 47:
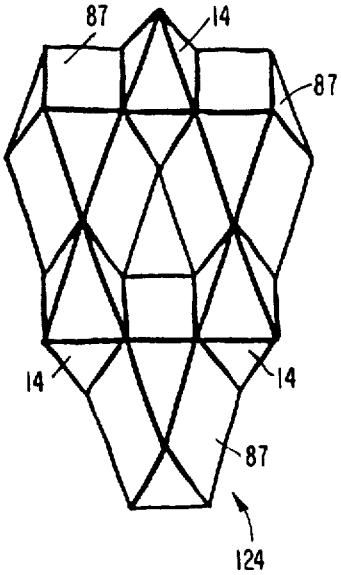
Figure 48:
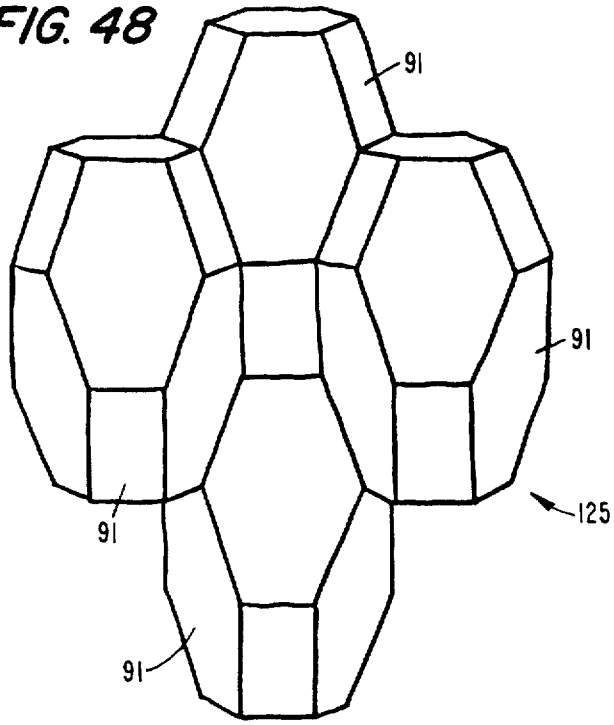
Figure 49:
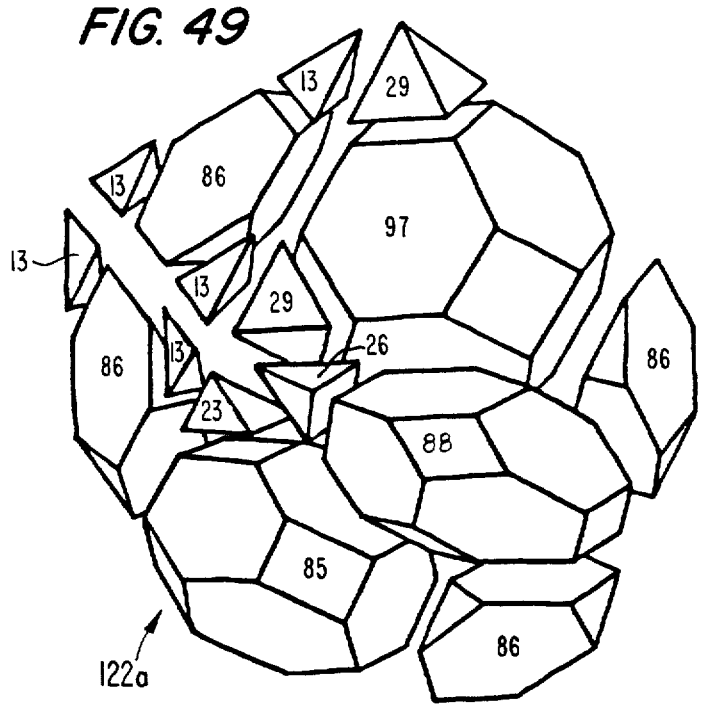
Figure 50:
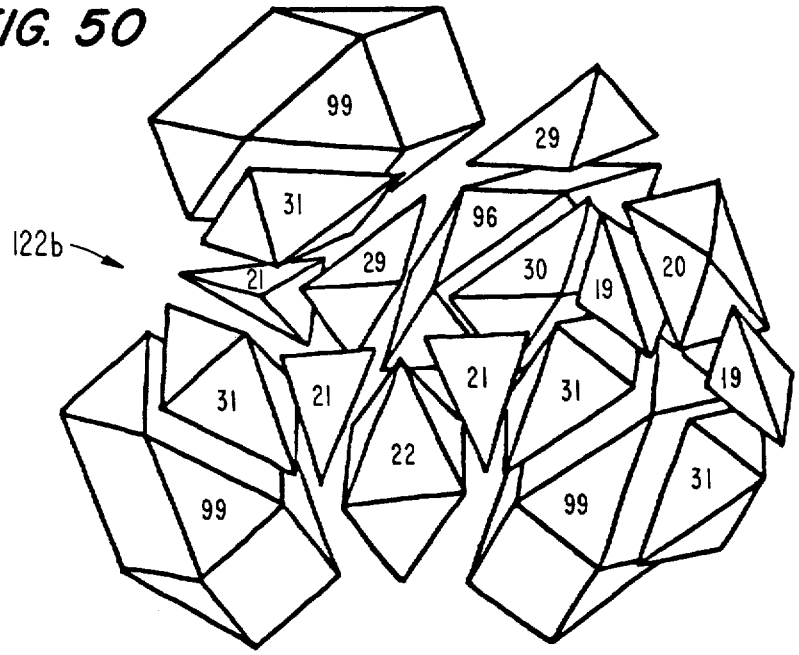

FIG. 17 is a front elevational view of the mid-layer of a $\phi$-icosahedron in the form of a pentagonal anti-prism, the left-hand part of FIG. 17 being in connected form while the right-hand part being in exploded form;

FIG. 18 is a front elevational view of a dodecahedron formed from the polygons of FIG. 1, the left-hand part labelling these polygons;

FIGS. 19–21 are front elevational views, respectively, of the top, middle and bottom layers of the dodecahedron of FIG. 18;

FIGS. 22–25 are plan views of the top and bottom polygons forming the three layers of FIGS. 19–21;

FIG. 26 is a front elevational view of a portion of a layered non-periodic space filling using the polyhedra of the invention;

FIG. 27 is a front elevational view of four hexagons formed from six each of the four elemental triangular polygons of FIG. 1;

FIG. 28 is a front elevational view of the truncated tetrahedra, cuboctahedra and truncated octahedra formed from the polygons of FIG. 1 and the hexagons of FIG. 27;

FIG. 29 is a front elevational view of a clustered polyhedra including a partial filling of a truncated icosahedron with additional truncated tetrahedra and a truncated octahedron;

FIG. 30 is a front elevational view of a layer of a $\phi$-truncated icosahedron, with FIG. 31 showing its bottom plane as a $\phi$-decagon in plan view, with FIG. 32 showing a smaller decagonal plane, and with FIG. 33 showing a regular decagon subdivided into hexagons and triangles;

FIG. 34 is a front elevational view of six rhombii, each formed by two of the elementary polygons of FIG. 1;

FIGS. 35–44 are front elevational views of rhombohedra and parallelopipeds formed by the rhombii of FIG. 34, the left-hand part of each of FIGS. 35–43 being labelled with the elementary polyhedra from FIG. 2 and the right-hand part being labelled with the elementary polygons of FIG. 1 and the rhombii of FIG. 34;

FIG. 45 is an exploded front elevational view of a non-periodic space filling in accordance with the invention using a plurality of rhombohedra and parallelopipeds from FIGS. 35–44, these rhombohedra and parallelopipeds being formed from the polyhedra of FIG. 2, which are in turn formed from the polygons of FIG. 1;

FIGS. 46–48 are front elevational views of periodic space fillings in accordance with the invention using tetrahedra and octahedra of FIG. 2 and cuboctahedra and truncated octahedra of FIG. 28, each of which are formed from the polygons of FIG. 1;

FIGS. 49 and 50 are front elevational views of non-periodic space fillings in accordance with the invention using tetrahedra and half-octahedra of FIG. 2 and truncated tetrahedra and truncated octahedra of FIG. 28; and FIGS. 51–54 are front elevational views of edge connections used to connect adjacent edges of the FIG. 1 polygons to form the polyhedra illustrated herein.

DETAILED DESCRIPTION OF THE INVENTION 1. 10 Elementary Polygons

The building system of the invention is composed of a family of 10 elementary polygons as seen in FIG. 1 having two edges in a ratio of 1 to 0, where 0 is the golden mean and equals 1.61803 . . . , and where only the following combinations of edges and contained angles are permissible:

Four triangular members 1–4, where members 1 and 4 are both equilateral with edges 1 and $\phi$ respectively; triangular member 2 is an isosceles triangle with two edges of 1, a base of $\phi$, two base angles of 36° and an apex angle of 108°; triangular member 3 is an isosceles triangle with two edges of $\phi$, a base of 1, two base angles of 72° and an apex angle of 36° and Six parallelogram-shaped members 6–10 as follows: members 5 and 7 are squares with edges 1 and $\phi$ respectively; member 6 is a rectangle with edges 1 and $\phi$; member 8 is a 36° rhombus of edge 1; member 9 is a 60° parallelogram with edges 1 and $\phi$; and member 10 is a 72° rhombus of edge $\phi$.

Each polygon has coplanar edges and is either a solid panel or formed as an open lattice by its edges. Each edge has a means to connect it to an adjacent edge of another polygon, such as mating teeth, the combination of tongues and a hollow tube receiving the tongues at its ends, or magnets, or alternatively, adjacent edges can be connected via glue, nails or screws.

As illustrated in the drawings, edge 1 has a length of one unit approximating an inch, although this one unit could be a foot, a yard, a mile, etc. Moreover, edge 1 can be any length as long as edges 1 and $\phi$ are in a ratio of 1.61803 . . . , i.e., 1 times $\phi$. As set forth in the claims, the edges of the polygons disclosed herein are represented by "x+ and "x$\phi$".

2. 12 Elementary Polyhedra (Tetrahedra and Octahedral)

The elementary polygons combine with each other to produce six complementary pairs of polyhedra as seen in the first and second columns of FIG. 2 which act as three-dimensional building blocks or members that can be solid or hollow. Each pair makes a family consisting of a tetrahedron and an octahedron with the octahedron having twice the number of the same faces as its associated tetrahedron. Each tetrahedron is bounded by four triangles, each octahedron by eight triangles, and the 12 elementary polyhedra are referenced as 11–22.

Tetrahedron 11 is composed of two equilateral traingles 1 and two isosceles triangles 2; the octahedron 12 has four each of triangles 1 and 2. The mid-planes of the octahedron are the rectangle 6 and two rhombii 8.

Tetrahedron 13 is composed of one triangle 1, two triangles 2 and one triangle 3; the octahedron 14 has two triangles 1, four triangles 2 and two triangles 3, and its mid-planes are the square 5 and two rhombii 9.

Tetrahedron 15 is composed of triangles 1 and three triangles 3; the octahedron 16 has two triangles 1 and six triangles 3 and its mid-planes are three rectangles 6.

Tetrahedron 17 is composed of three triangles 2 and one triangles 4; the octahedron 18 has six triangles 2 and two triangles 4; and its mid-planes are the three rectangles 6.

Tetrahedron 19 is composed of one triangle 2, two triangles 3 and one triangle 4; octahedron 20 has two triangles 2, four triangles 3 and two triangles 4, and its mid-planes are one square 7 and two rhombii 9.

Tetrahedron 21 has two triangles 3 and two triangles 4; its associated octahedron 22 has four triangles 3 and four triangles 4 with the mid-planes of one rectangle 6 and two rhombii 10.

3. Half-Octahedra (Pyramids)

The six octahedra 12, 14, 16, 18, 20 and 22 can be bisected along their mid-planes to produce half-octahedra or pyramids which are useful for producing certain close-packed arrangements. These polyhedra maintain the two edge-lengths 1 and $\phi$ and are composed of the elementary polygons. Ten different half-octahedra can be derived from the six octahedra as seen in the third and fourth columns of FIG. 2.

Octahedron 12 can be bisected into two ways to produce the half-octahedra 23 and 24.

Octahedron 14 can be bisected into half-octahedra 25 and 26.

Octahedra 16 and 18 each produce one half-octahedron 27 and 28 respectively.

Octahedron 20 produced half-octahedra 29 and 30, and octahedron 22 produces half-octahedra 31 and 32.

4. Non-Periodic Space-Fillings

The 12 elementary tetrahedra and octahedra as well as the ten half-octahedra serve as building blocks that fit together tightly without gaps to fill all space. The space-fillings are non-periodic, as well as periodic, and the orientation of the modules is such that all edges of the polyhedral cells are parallel to the fifteen 2-fold axes of rotation of icosahedral symmetry. These axes can be visualized as the lines joining the center to the mid-points of the 30 edges of a regular icosahedron, a polyhedron with 20 equilateral triangles having five triangles meeting at every vertex; and mid-points of the opposite edges lie on the same axis. In this sense, the space-fillings can be described as 15-directional, or as projections of 15-dimensional space in three-dimensions.

4.1 Larger Replicas of Elementary Polyhedra

In order to prove that the 12 elementary building blocks are necessary and sufficient to fill all space non-periodically, the following must be demonstrated:

(1) The blocks can produce larger replicas of themselves by packing them together, and (2) The replicas are larger by a factor of $\phi$, or $\phi^2$, or $\phi^3$, etc.; this way the replication process is according to the golden series $\phi$, $\phi^2$, $\phi^3$, $\phi^4$, $\phi^5$, . . . which divides space in incommensurate increments, and hence non-periodically.

For some of the six tetrahedra and six octahedra 11–22, larger replicas are illustrated in FIGS. 3–12. The elementary blocks have the original two edges 1 and $\phi$, the larger blocks are bigger by $\phi$ and hence their edges are $\phi$ and $\phi^2=1+\phi$. The decomposition of the larger blocks into the smaller blocks is described below.

Figure 3:
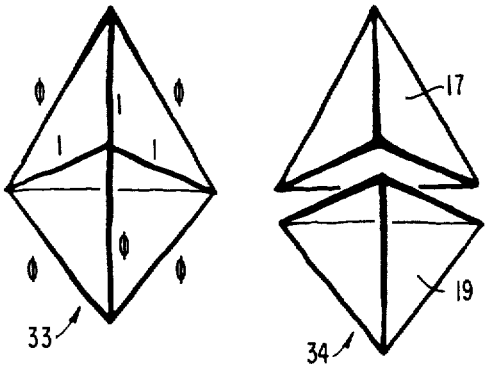
FIGS. 3–13 are front elevational views of the larger replicas of the variously combined tetrahedra, octahedra and half-octahedra shown in FIG. 2, the left-hand part of each FIG. 3–13 showing the replicas in connected form while the right-hand part of each FIG. 3–13 showing the replica is in exploded form.
Figure 4:
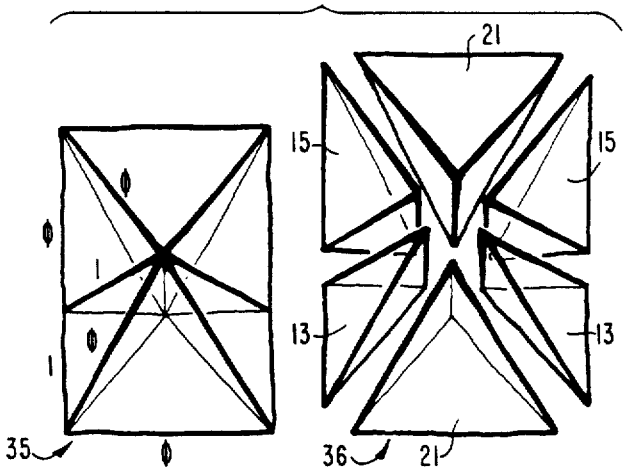
Figure 6:
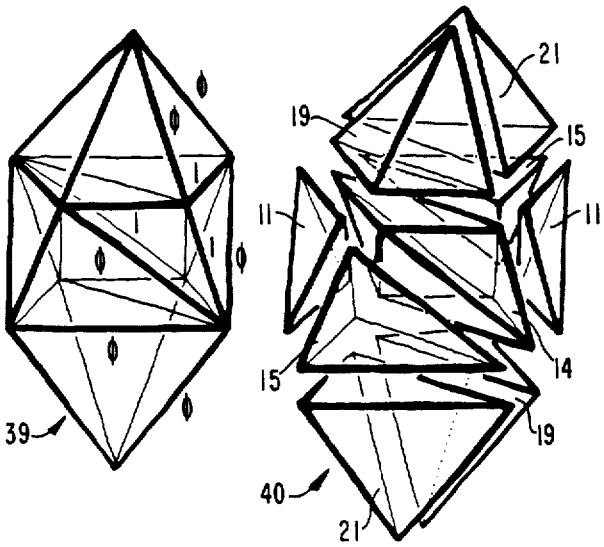

The tetrahedron 11 becomes the $\phi$-tetrahedron 33, 34 in FIG. 3 out of two tetrahedra, one 17 and one 19. The $\phi$-octahedron 35, 36 in FIG. 4 corresponding to the elementary octahedron 12 is composed by six tetrahedra, two each of 13, 15 and 21.

Figure 5:
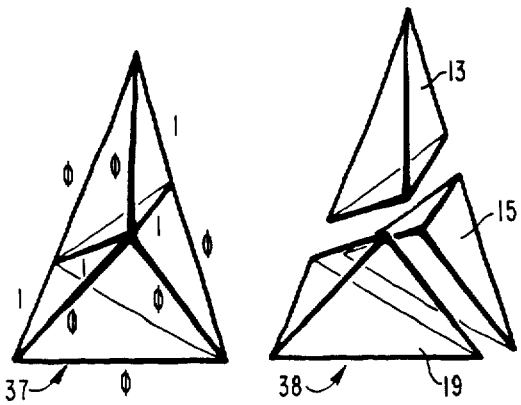

The $\phi$-tetrahedron 37, 38 in FIG. 5 corresponding to the elementary tetrahedron 13 is composed of three tetrahedra, one each of 13, 15 and 19. The $\phi$-octahedron 39, 40 in FIG. 6 corresponding to the elementary octahedron 14 is composed of eight tetrahedra, two each of 11, 15, 19 and 21 and one octahedron 14.

Figure 7:
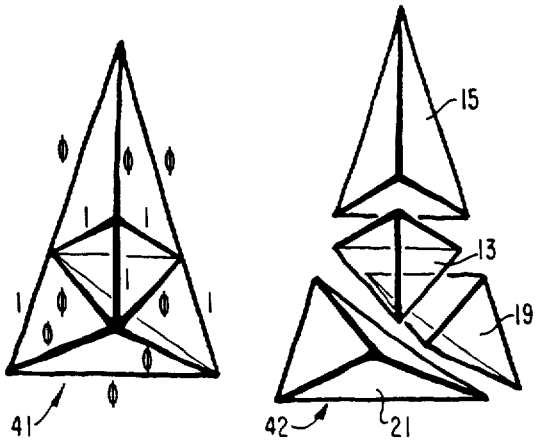
Figure 8:
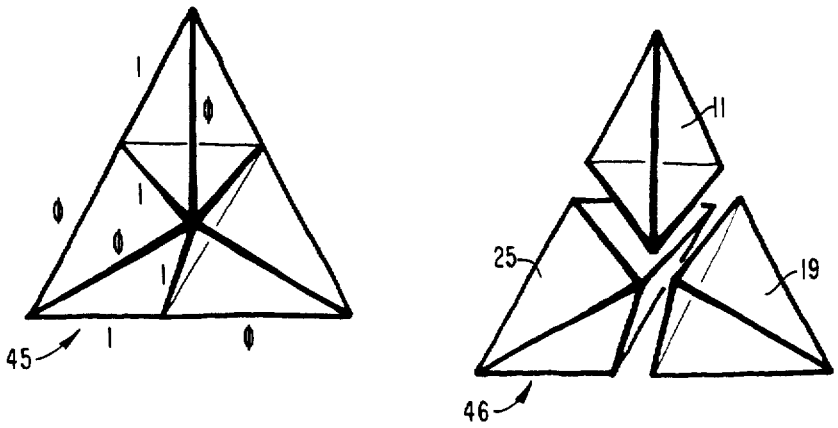

The $\phi$-tetrahedron 41, 42 in FIG. 7 corresponding to 15 is composed of four tetrahedra, one each of 13, 15, 19 and 21.

Figure 9:
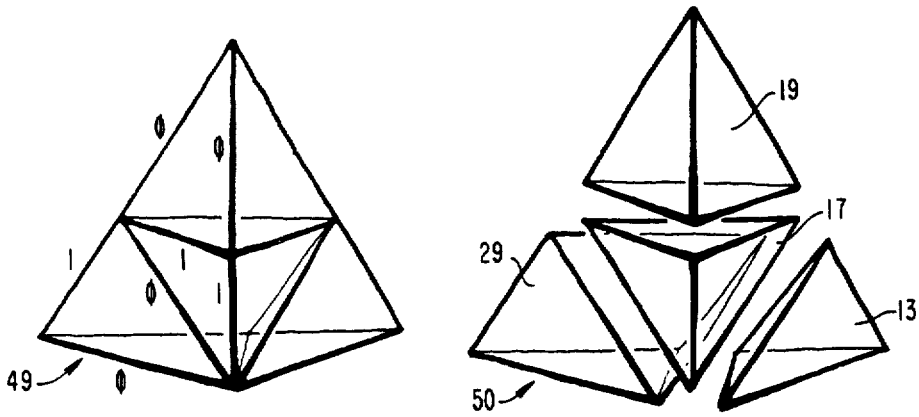

The $\phi$-tetrahedron 45, 46 in FIG. 9 corresponding to tetrahedron 17 is composed of two tetrahedra, one each of 11 and 19, and one half-octahedron 25. The $\phi$-octahedron 47, 48 in FIG. 12 corresponding to 18 is composed of four tetrahedra 13, two half-octahedra 25 and two octahedra, one 12 and one 20.

Figure 10:
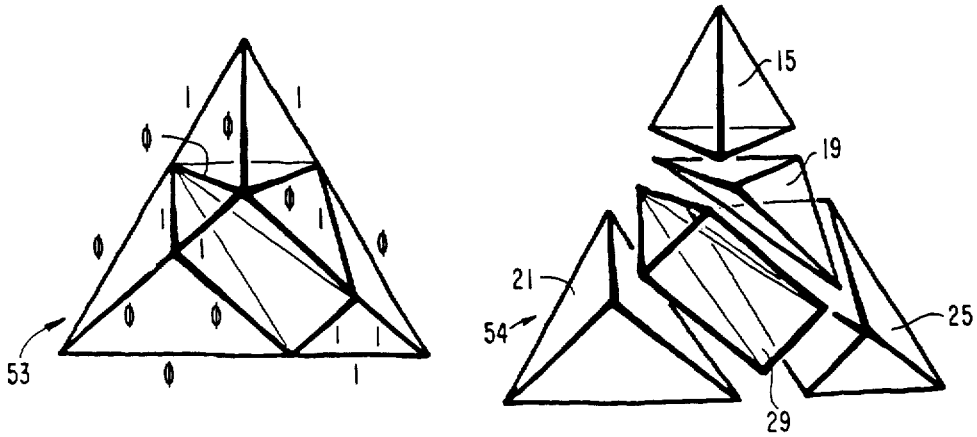

The $\phi$-tetrahedron 49, 50 in FIG. 10 corresponding to 19 is composed of three tetrahedra, one 13, one 17 and one 19, and one half-octahedron 29. The $\phi$-octahedron 51, 52 in FIG. 13 corresponding to 20 is composed of ten tetrahedra, three 13, two 15, three 19 and two 21, two half-octahedra, one 25 and one 29, and one octahedron 14.

Figure 11:
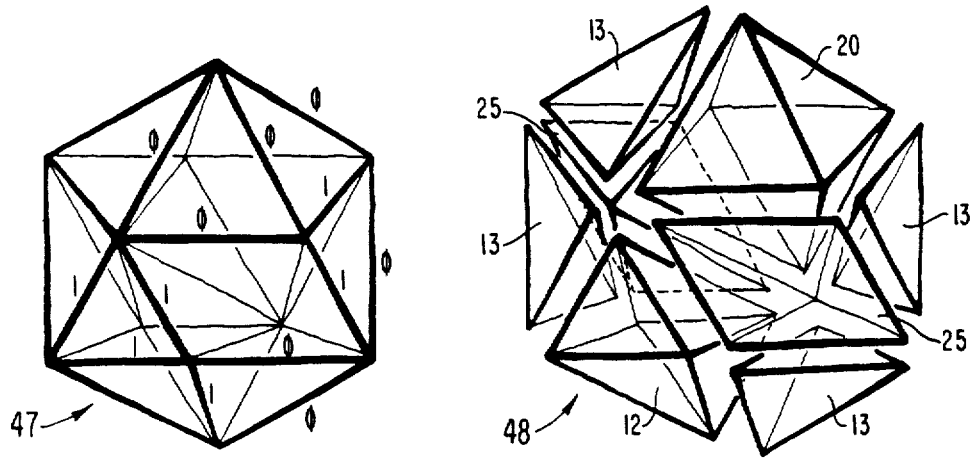
Figure 12:
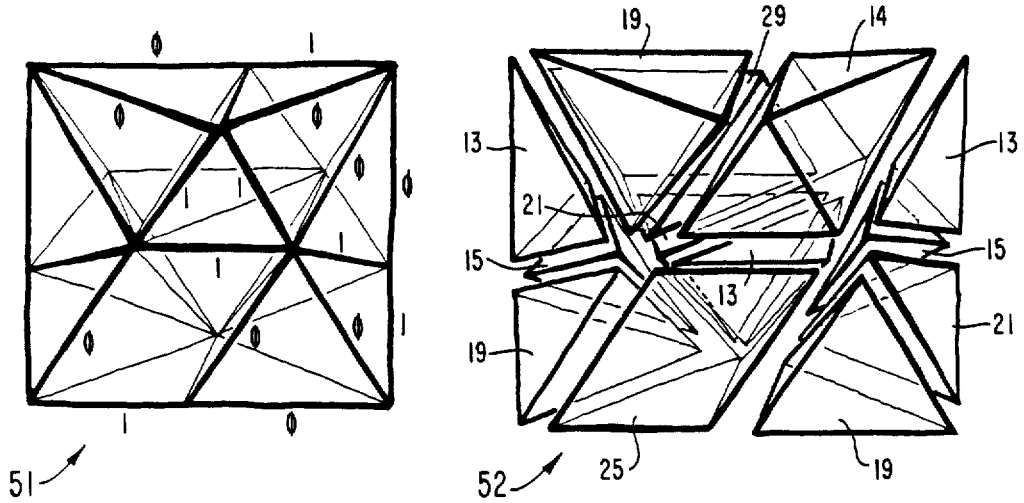

The $\phi$-tetrahedron 53, 54 in FIG. 11 corresponding to 21 is composed of three tetrahedra, one each of 15, 19 and 21, and two half-octahedra, one each of 25 and 29.

Figure 13:
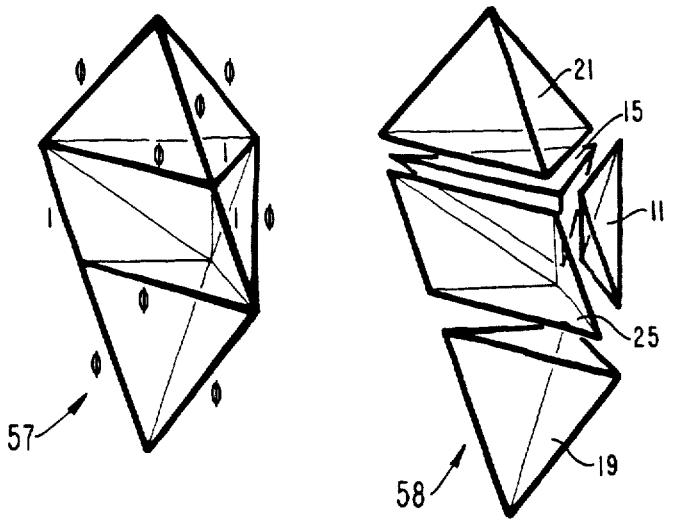

One example of a $\phi$-half-octahedron 57, 58 corresponding to 25 is illustrated in FIG. 13; it consists of four tetrahedra, one each of 11, 15, 19 and 21, and one half-octahedron 25. Other examples can be similarly worked out.

Figure 14:
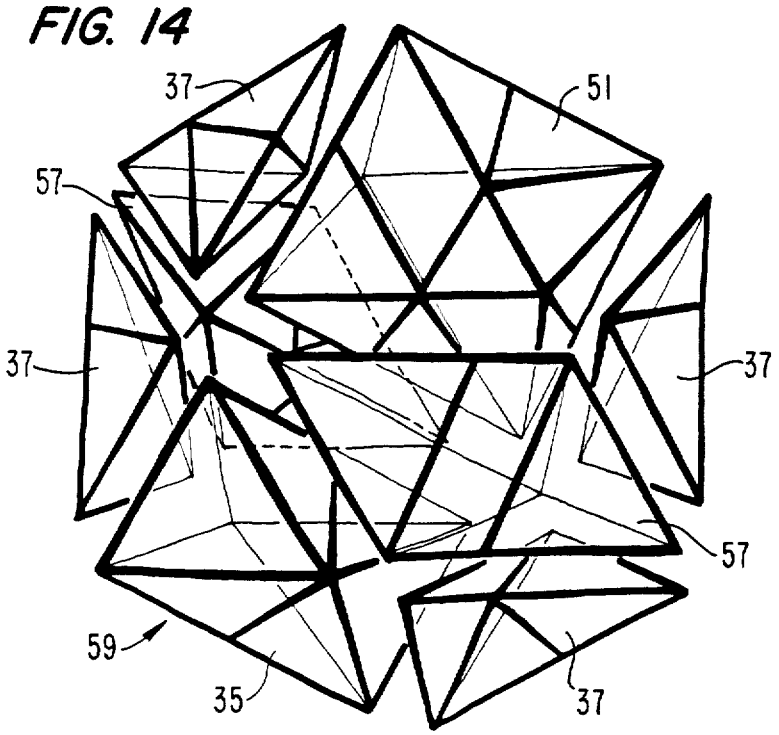
FIG. 14 is an exploded front elevational view of a $\phi^2$-octahedron made of $\phi$-tetrahedra, $\phi$-half-octahedra, and $\phi$-octahedra.

All the $\phi$-modules 33–42, 45–54 and 57–58 can now act as building blocks to produce even larger replicas in the same manner as before, and the process can be continued forever. One example of a $\phi^2$-octahedron corresponding to 48 is illustrated as 59 in FIG. 14. It consists of four $\phi$-tetrahedra 37, two $\phi$-half-octahedra 57, one $\phi$-octahedron 35 and one $\phi$-octahedron 51. Other examples can be worked out using a similar procedure.

4.2 Regular-Faced Polyhedra from Elementary Polyhedra

The 12 elementary polyhedra are also the building blocks for polyhedra which are made of regular polygons and correspond to icosahedral symmetry. The following polyhedra can be built from these modules: the regular icosahedron and dodecahedron, the icosidodecahedron, the truncated icosahedron, the truncated dodecahedron, the rhombicosidodecahedron and the truncated icosidodecahedron. The first two are the well-known Platonic solids, and the remaining five are the well-known semi-regular polyhedra attributed to Archimedes. In addition, some of the stellated polyhedra can also be produced from these modules.

Figure 15:
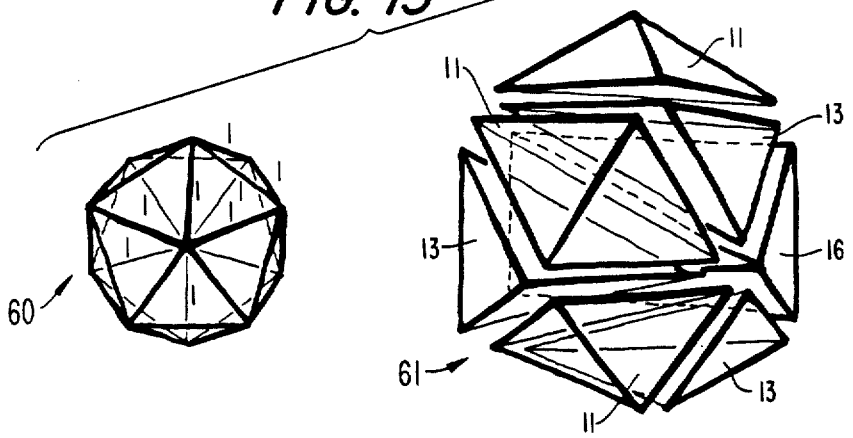
FIG. 15 is a front elevational view of a regular icosahedron formed of nine tetrahedra and an octahedron, the left-hand part being in connected form while the right-hand part being in exploded form.
Figure 16:
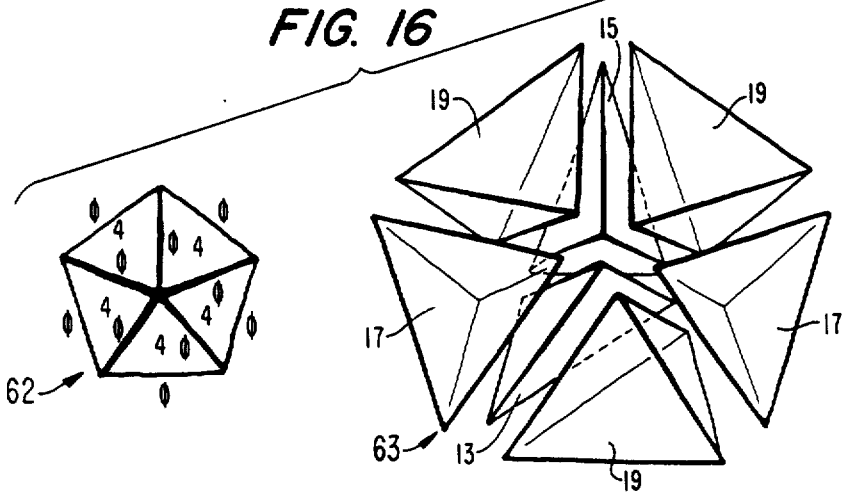
FIG. 16 is a front elevational view of both top and bottom layers of a $\phi$-icosahedron, these layers being pentagonal pyramids, the left-hand part of FIG. 16 being in connected form while the right-hand part being in exploded form.

Two examples are illustrated. The first in FIG. 15 shows a regular icosahedron 60, 61 of edge 1 composed of 12 tetrahedra, six of 11 and six of 13, along with one octahedron 16. A larger icosahedron of edge $\phi$ can be produced out of twenty tetrahedra and four octahedra. It can be decomposed in three layers, where the top and the bottom are similar pentagonal pyramids 62, 63 shown in FIG. 16, each composed of seven tetrahedra, one each of 13 and 15, two of 17, and three of 19, and the mid-layer is a pentagonal anti-prism 64, 65 shown in FIG. 17 composed of six tetrahedra, four of 19 and two of 21, and four octahedra, three of 22 and one of 20.

The second example shows a dodecahedron 66–74 of edge 1 in FIGS. 18–25. The non-periodic surface breakdown into elementary triangles 2 and 3 is shown in FIG. 18; twenty-four of 2 and twelve of 3 are necessary. When packed with 3-d modules, twenty tetrahedra and eight octahedra are necessary in the arrangement shown. The packing is illustrated in three layers 68–70 which show the space division with only triangles. The top and bottom polygons of these three layers are shown as 71–74. Pentagons 71, 72 are the top and bottom layers of 68; 72, 73 are the top and bottom layers of 69; and 73, 74 are the top and bottom of 70. Pentagons 71, 74 have an edge 1 and are composed of three elementary triangles, two of 2 and one of 3; pentagons 72, 74 have an edge $\phi$ and are composed of three triangles of 2 and four triangles of 3.

From these polyhedra composed of the elementary modules, space-fillings can be derived in two ways:

(1) by replacing elementary cells with larger replicas as in Sec. 4.1 above, or (2) by using these regular-faced polyhedra as in Sec. 4.2 to produce packings and space-fillings.

One example of the second type is shown with a portion of a non-periodic layered space-filling 75 in FIG. 26. The layers 63, 65, and 68–70 could be extended and stacked. Full or partial polyhedral cells are seen. 76 is an embedded dodecahedron, 77 is an icosahedron which is partially visible, and 78 is an icosidodecahedron.

5. Composite Polygons and Polyhedra

The elementary triangular members 1–4 can be combined to produce larger composite polygons which in combinations with the other elementary polygons 5–10 can act as faces of new sets of polyhedra. Similarly, the tetrahedra, octahedra or half-octahedra can be combined to produce larger composite polyhedra. These polyhedra increase the variety of three-dimensional volumes which can be used to produce space-fillings and configurations.

5.1 Hexagons

The four elementary triangular members 1–4 in FIG. 1 can each be combined to produce four corresponding hexagons seen in FIG. 27 by fitting six around a point. Member 1 produces a regular hexagon 79 with an edge 1, member 2 produces a flattened hexagon 80 with edges 1 and $\phi$ and angles 72° and 104°, member 3 produces an elongated hexagon 81 with edges 1 and $\phi$ and angles 108° and 144°, and member 4 produces a regular hexagon 82 of edge $\phi$.

5.2 Polyhedra with Non-Regular Faces

Corresponding to the six pairs of tetrahedra and octahedra 11–22, polyhedra 83–100 as seen in FIG. 28 with non-regular faces can be produced by combining the four hexagons 79–82 and the original ten elementary polygons 1–10. Six sets of three polyhedra, namely, the truncated tetrahedron, the cuboctahedron, and the truncated octahedron are described below. These can be seen as affine (i.e., sheared) variants of the well-known Archimedean polyhedra by the same name.

5.3 Truncated Tetrahedra

The truncated tetrahedral polyhedrons are composed of four triangles and four hexagons.

Truncated tetrahedron 83 is composed of two hexagons 79, two hexagons 80, two triangles 2, and two triangles 1.

Truncated tetrahedron 86 is composed of one hexagon 79, two hexagons 80, one hexagon 81, two triangles 2, one triangle 3, and one triangle 1.

Truncated tetrahedron 89 is composed of three hexagons 81, one hexagon 79, three triangles 3, and one triangle 1.

Truncated tetrahedron 92 has three hexagons 80, one hexagon 82, three triangles 2, and one triangle 4.

Truncated tetrahedron 95 has two hexagons 81, one hexagon 82, one hexagon 80, one triangle 2, one triangle 4, and two triangles 3.

Truncated tetrahedron 98 has two hexagons 81, two hexagons 82, two triangles 4, and two triangles 3.

5.4 Cuboctahedra

The cuboctahedral polyhedrons are composed of six parallelograms and eight triangles.

Cuboctahedron 84 has two parallelograms 6, four parallelograms 8, four triangles 2 and four triangles 1.

Cuboctahedron 87 has two parallelograms 5, four parallelograms 9, four triangles 2, two triangles 1 and two triangles 3.

Cuboctahedron 90 has six parallelograms 6, six triangles 3 and two triangles 1.

Cuboctahedron 93 has six parallelograms 6, six triangles 2 and two triangles 4.

Cuboctahedron 96 has two parallelograms 7, four parallelograms 9, four triangles 3, two triangles 4 and two triangles 2.

Cuboctahedron 99 has four parallelograms 10, two parallelograms 6, four triangles 3 and four triangles 4.

5.5 Truncated Octahedra

The truncated octahedral polyhedrons are composed of six parallelograms and eight hexagons.

Truncated octahedra 85 has four hexagons 79, four hexagons 80, four parallelograms 8 and two parallelograms 6.

Truncated octahedra 88 has four hexagons 80, two hexagons 81, two hexagons 79, four parallelograms 9 and two parallelograms 5.

Truncated octahedra 91 has six hexagons 81, two hexagons 79 and six parallelograms 6.

Truncated octahedra 94 has six hexagons 80, two hexagons 82 and six parallelograms 6.

Truncated octahedra 97, has four hexagons 81, two hexagons 82, two hexagons 80, four parallelograms 9 and two parallelograms 7.

Truncated octahedra 100 has four hexagons 81, four hexagons 82, four parallelograms 10 and two parallelograms 6.

5.6 Space-Fillings with Composite Polyhedra

A few clusters of composite polyhedra are shown in FIGS. 29–33. Cluster 101 shows a partial non-periodic filling of a truncated icosahedron of edge 1 with some truncated tetrahedra and a truncated octahedron. Cluster 102 shows a layer of a $\phi$-truncated icosahedron, its bottom plane is a $\phi$-decagon 103 with edges $\phi$ and $\phi^2$ subdivided into elementary and composite polygons. A similar subdivision of a smaller decagonal plane is shown as 104. A regular decagon can be subdivided into hexagons and triangles is shown as 105. This decagonal subdivision acts as the face of a truncated dodecahedron or a truncated icosidodecahedron, or a section through a rhombicosidodecahedron, when these polyhedra are produced by the close-packing of the composite polyhedra. The composite polyhedra along with the elementary polyhedra fill space in a manner similar to the packings of tetrahedra and octahedra described in Sec. 4.2 above.

6. Rhombii, Rhombohedra and Parallelopipeds

The elementary triangles 1–4 produce six additional composite polygons which are parallelograms 106–111 as seen in FIG. 34, each composed of a pair of triangles. These can also be seen as parts of the hexagons shown in FIG. 27. A pair of triangles 2 produces the 36° parallelogram 106 and the 72° rhombus 109, a pair of triangles 3 produces the 36° rhombus 107 and the 72° parallelogram 108, and a pair of triangles 1 and 4 each produce a 60° rhombus shown as 110 and 111 respectively. These six parallelograms in combination with the six elementary parallelograms 5–10 act as faces of a large set of composite building blocks which are parallelopipeds and rhombohedra. These polyhedra, like the elementary polygons, have two edge-lengths, and fill space both periodically and non-periodically. Each parallelopiped or rhombohedron is composed of three pairs of parallel faces, and its twelve edges are parallel to three directions of space. Composite parallelopipeds and rhombohedra produce larger, more complex structures termed zonohedra, whose outer shells are convex space enclosures made of the same rhombii and parallelograms.

Three-dimensionally, the parallelopiped and rhombohedra produced by the system described here are composed of the elementary tetrahedra and octahedra or half-octahedra 11–32. Derivation of ten composite polyhedra 112–121 seen in FIGS. 35–44 from the elementary polyhedra is described as illustrative examples. Others can be similarly derived. Polyhedra 112, 113, 114 and 115 are derived from the first tetrahedron-octahedron pair 11, 12 and its associated half-octahedra 23, 24, 116–120 are derived from the second tetrahedron-octahedron pair 13, 14 and its half-octahedra 25, 26, and 121 is from the combination of the two pairs. 113, 114 and 118 are rhombohedra of edge 1, the remaining seven are parallelopipeds of the edges 1 and $\phi$.

112 is composed of two tetrahedra 11 and one octahedron 12; its faces are two rhombii 110 and four parallelograms 106.

113 is also composed of the two tetrahedra 11 and one octahedron 12 but combined differently; its faces are two rhombii 110 and four rhombii 109.

114 is composed of two tetrahedra 11 and two half-octahedra 23; its faces are six rhombii, two of 8 and four of 110.

115 is composed of two tetrahedra 11 and two half-octahedra 24; its faces are two rectangles 6, two parallelograms 106 and two rhombii 110.

116 is composed of two tetrahedra 13 and one octahedron 14; its faces are two rhombii 107 and four parallelograms 106.

117 is also composed of two 13 and one 14, but its faces are two each of 106, 108 and 110.

118 is also composed of two 13 and one 14; its faces are two 110 and four 109.

119 is composed of two 13 and two half-octahedra 25; its faces are two each of 9, 106 and 109.

120 is composed of two 13 and two half-octahedra 26; its faces are two each of 5, 106 and 108.

121 is a more complex one consisting of two tetrahedra 11, two tetrahedra 13, one octahedron 14 and two half-octahedra 24; its faces are two rectangles 6, two rhombii 10 and two parallelograms 106.

7. Non-Periodic Space Filling with Rhombohedra and Parallelopipeds

One example of a non-periodic space filling with several parallelopiped and rhombohedra is shown in FIG. 45. This arrangement 122 uses six polyhedra 112, 113, 115, 116, 117 and 121 in a layer upon which other layers can be stacked. Arrangements without layers are also possible using these and others derived from the elementary polygons and elementary polyhedra. The parallelopiped and rhombohedra packed this way can be decomposed into their elementary cells to produce alternative space fillings with tetrahedra and octahedra. Basically, when tetrahedra and octahedra pairs and truncated tetrahedra, cuboctahedra and truncated octahedra are matched in the same family, a periodic space filling will result. But when these polyhedra are mixed out of their family, then a non-periodic space filling will result, as seen in FIG. 45. Non-periodic space fillings **122*a* and 122*b* are also shown in FIGS. 49 and 50 using tetrahedra and half-octahedra of FIG. 2 and truncated tetrahedra and truncated octahedra of FIG. 28**.

8. Periodic Space Filling

As seen in FIGS. 46–48, three periodic space fillings 123–125 are provided. In FIG. 46, tetrahedra 13 and octahedra 14 from FIG. 2 are used; in FIG. 47, octahedra 14 from FIG. 2 and cuboctahedra 87 from FIG. 28 are used; and in FIG. 48, truncated octahedra 91 from FIG. 28 are used.

9. Edge Connections

Figure 51:
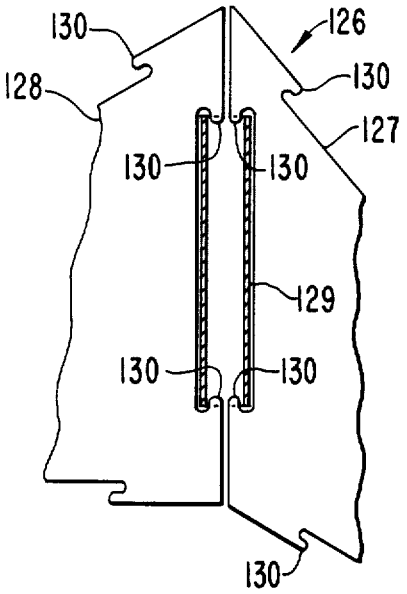
Figure 52:
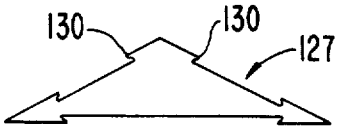

In FIGS. 51 and 52, an edge connection 126 is illustrated to connect two or more adjacent polygonal members 127 and 128 via a hollow tube 129 and tongues 130 formed on the polygonal members.

Figure 53:
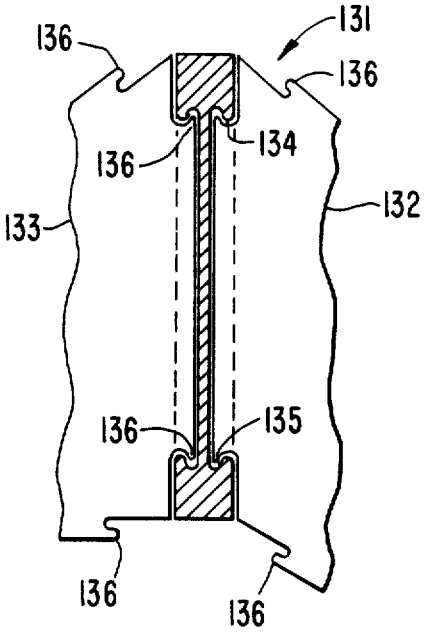
Figure 54:
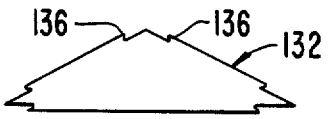

In FIGS. 53 and 54, a modified edge connection 131 is illustrated to connect two or more adjacent polygonal members 132 and 133 via a member having facing annular rims 134 and 135 receiving tongues 136 formed on the polygonal members therein.

These edge connections can be thought of as a design of a "universal strut", as opposed to a "universal node" for building space frame configurations.

10. Overall Combinations of Polygons and Polyhedra

Thus, the ten elementary polygons shown in FIG. 1 can be combined to form tetrahedra and octahedra shown in FIG. 2. These tetrahedra and octahedra can in turn be combined to fill space periodically, when the polyhedra in the same family are combined, and to fill space non-periodically, when the polyhedra in different families are combined. In addition, the half-octahedra in FIG. 2 can be added to the tetrahedra and octahedra to likewise fill space periodically and non-periodically.

In addition, the ten elementary polygons of FIG. 1 can be added to the four composite hexagons shown in FIG. 27 to form truncated tetrahedra, cuboctahedra and truncated octahedra shown in FIG. 28. These polyhedra, in combination with the elementary polyhedra, can in turn be combined to fill space periodically, when the polyhedra in the same family are combined, and to fill space non-periodically, when the polyhedra in different families are combined as illustrated in FIGS. 45–50. Moreover, these polyhedra are also capable of being broken down into the tetrahedra, octahedra and half-octahedra of FIG. 2.

Finally, the four elementary triangles of FIG. 1 can be formed into rhombii and then combined with the six remaining elementary parallelograms to in turn form parallelopipeds and rhombohedra, ten of which are shown in FIGS. 35–44. These polyhedra can in turn be combined to fill space periodically or non-periodically as seen in FIG. 45. Moreover, these polyhedra are also capable of being broken down into the tetrahedra, octahedra, and half-octahedra of FIG. 2.

While various advantageous embodiments have been chosen to illustrate the invention, it will be understood by those skilled in the art that various changes and modifications can be made therein without departing from the scope of the invention as defined in the appended claims.

What is claimed is:

1. A set of polygonal members for constructing a building structure and being combinable to form a set of polyhedral members that, when placed adjacent one another, continuously fill three-dimensional space periodically or non-periodically, the combination comprising:

ten elementary polygonal members, which have coplanar straight edges, including where $\phi$ is 1.61803, a first triangular member, which is equilateral, has three interior angles of 60° each, and has three equal edges of a length x, a second triangular member, which is isosceles, has two base angles of 36° and an apex angle of 108°, and has two edges of a length x and a base of xϕ, a third triangular member, which is isosceles, has two base angles of 72° and an apex angle of 36°, and has two edges of a length xϕ and a base of x, a fourth triangular member, which is equilateral, has three interior angles of 60° each, and has three equal edges of a length xϕ, a first parallelogram-shaped member, which is square, has four interior angles of 90° each, and has four equal edges of a length x, a second parallelogram-shaped member, which is a rectangle, has four interior angles of 90° each, and has two equal edges of a length x and two other equal edges of a length xϕ, a third parallelogram-shaped member, which is square, has four interior angles of 90° each, and has four equal edges of a length xϕ, a fourth parallelogram-shaped member, which is a rhombus, has two interior angles of 36° and two other interior angles of 144°, and has four equal edges of a length x, a fifth parallelogram-shaped member, which has two interior angles of 60° and two other interior angles of 120°, and has two equal edges of a length x and two other equal edges of a length xϕ, and a sixth parallelogram-shaped member, which is a rhombus, has two interior angles of 72° and two other interior angles of 108°, and has four equal edges of a length xϕ, said ten elementary polygonal members being combinable to produce six complementary pairs of polyhedral three-dimensional building members, the orientation of said polyhedral building members, when placed adjacent one another, being such that all edges of said building members are parallel to the fifteen two-fold axes of rotation of icosahedral symmetry, said building members being capable of filling three-dimensional space periodically or non-periodically.

2. A set of polygonal members according to claim 1, wherein said six complementary pairs of polyhedral three-dimensional building members each include a tetrahedral member and an octahedral member.

3. A set of polygonal members according to claim 2, wherein said six complementary pairs of polyhedral three-dimensional building members comprise a first pair including a first tetrahedron comprised of two of said first triangular members and two of said second triangular members, and a first octahedron comprised of four of said first triangular members and four of said second triangular members, the three mid-planes of said first octahedron having shapes in the form of said second parallelogram-shaped member and two of said fourth parallelogram-shaped members, a second pair including a second tetrahedron comprised of said first triangular member, two of said second triangular members, and said third triangular member, and a second octahedron comprised of two of said first triangular members, four of said second triangular members and two of said third triangular members, the three mid-planes of said second octahedron having shapes in the form of said first parallelogram-shaped member and two of said fourth parallelogram-shaped members, a third pair including a third tetrahedron comprised of said first triangular member and three of said third triangular members, and a third octahedron comprised of two of said first triangular members and six of said third triangular members, the three mid-planes of said third octahedron having shapes in the form of three of said second parallelogram-shaped members, a fourth pair including a fourth tetrahedron comprised of three of said second triangular members and one of said fourth triangular members, and a fourth octahedron comprised of two of said second triangular members and four of said fourth triangular members, the three mid-planes of said fourth octahedron having shapes in the form of three of said second parallelogram-shaped members, a fifth pair including a fifth tetrahedron comprised of said second triangular member, two of said third triangular members, and one of said fourth triangular member, and a fifth octahedron comprised of two of said second triangular members, four of said third triangular members, and two of said fourth triangular members, the three mid-planes of said fifth octahedron having shapes in the form of said third parallelogram-shaped member and two of said fifth parallelogram-shaped members, and a sixth pair including a sixth tetrahedron comprised of two of said third triangular members and two of said fourth triangular members, and a sixth octahedron comprised of four of said third triangular members and four of said fourth triangular members, the three mid-planes of said sixth octahedron having shapes in the form of said second parallelogram-shaped member and two of said sixth parallelogram-shaped members.

4. A set of polygonal members according to claim 2, wherein said ten elementary polygonal members also combine to produce half-octahedral building members comprising said octahedral members divided in half along their mid-planes.

5. A set of polygonal members for constructing a building structure and being combinable to form a set of polyhedral members that, when placed adjacent one another continuously, fill three-dimensional space periodically or non-periodically, the combination comprising:

ten elementary polygonal members, which have coplanar straight edges, including where ϕ is 1.61803, a first triangular member, which is equilateral, has three interior angles of 60° each, and has three equal edges of a length x, a second triangular member, which is isosceles, has two base angles of 36° and an apex angle of 108°, and has two edges of a length x and a base of xϕ, a third triangular member, which is isosceles, has two base angles of 72° and an apex angle of 36°, and has two edges of a length xϕ and a base of x, a fourth triangular member, which is equilateral, has three interior angles of 60° each, and has three equal edges of a length xϕ, a first parallelogram-shaped member, which is square, has four interior angles of 90° each, and has four equal edges of a length x, a second parallelogram-shaped member, which is a rectangle, has four interior angles of 90° each, and has two equal edges of a length x and two other equal edges of a length $x\phi$, a third parallelogram-shaped member, which is square, has four interior angles of 90° each, and has four equal edges of a length $x\phi$, a fourth parallelogram-shaped member, which is a rhombus, has two interior angles of 36° and two other interior angles of 144°, and has four equal edges of a length x, a fifth parallelogram-shaped member, which has two interior angles of 60° and two other interior angles of 120°, and has two equal edges of a length X and two other equal edges of a length $x\phi$, and a sixth parallelogram-shaped member, which is a rhombus, has two interior angles of 72° and two other interior angles of 108°, and has four equal edges of a length $x\phi$, and four hexagonal members including a first hexagonal member formed of six of said first triangular members, a second hexagonal member formed of six of said second triangular members, a third hexagonal member formed of six of said third triangular members, and a fourth hexagonal member formed of six of said fourth triangular members, said ten elementary polygonal members and said four hexagonal members being combinable to produce six sets of polyhedral three-dimensional building members, said pairs each comprising a truncated tetrahedral member and either a cuboctahedral member or a truncated octahedral member, the orientation of said polyhedral building members, when placed adjacent one another, being such that all edges of said building members are parallel to the fifteen two-fold axes of rotation of icosahedral symmetry, said building members being capable of filling three-dimensional space periodically or non-periodically.

6. A set of polygonal members for constructing a building structure and being combinable to form a set of polyhedral members that, when placed adjacent one another continuously fill three-dimensional space periodically or non-periodically, the combination comprising:

ten elementary polygonal members, which have coplanar straight edges, including where $\phi$ is 1.61803, a first triangular member, which is equilateral, has three interior angles of 60° each, and has three equal edges of a length x, a second triangular member, which is isosceles, has two base angles of 36° and an apex angle of 108°, and has two edges of a length x and a base of $x\phi$, a third triangular member, which is isosceles, has two base angles of 72° and an apex angle of 36°, and has two edges of a length $x\phi$ and a base of x, a fourth triangular member, which is equilateral, has three interior angles of 60° each, and has three equal edges of a length $x\phi$, a first parallelogram-shaped member, which is square, has four interior angles of 90° each, and has four equal edges of a length x, a second parallelogram-shaped member, which is a rectangle, has four interior angles of 90° each, and has two equal edges of a length x and two other equal edges of a length $x\phi$, a third parallelogram-shaped member, which is square, has four interior angles of 90° each, and has four equal edges of a length $x\phi$, a fourth parallelogram-shaped member, which is a rhombus, has two interior angles of 36° and two other interior angles of 144°, and has four equal edges of a length x, a fifth parallelogram-shaped member, which has two interior angles of 60° and two other interior angles of 120°, and has two equal edges of a length x and two other equal edges of a length $x\phi$ and a sixth parallelogram-shaped member, which is a rhombus, has two interior angles of 72° and two other interior angles of 108°, and has four equal edges of a length $x\phi$, said ten elementary polygonal members being combinable to produce polyhedral three-dimensional building members, the orientation of said polyhedral building members, when placed adjacent one another, being such that all edges of said building members are parallel to the fifteen two-fold axes of rotation of icosahedral symmetry, said building members being capable of filling three-dimensional space periodically or non-periodically.

7. A set of polygonal member according to claim 6, wherein said polyhedral three-dimensional building members include rhombohedra and parallelopipeds.

8. A set of polygonal members according to claim 6, wherein said triangular members form six rhombii that are combined with said parallelogram-shaped members.

* * * * *

UNITED STATES PATENT AND TRADEMARK OFFICE

CERTIFICATE OF CORRECTION

PATENT NO. : 4,723,382

DATED : February 9, 1988

INVENTOR(S) : Haresh Lalvani

It is certified that error appears in the above-identified patent and that said Letters Patent is hereby corrected as shown below:

Cover page, in the title at [54], after "ICOSAHEDRAL", insert -- SYMMETRY --.

Column 1, line 3, after "ICOSAHEDRAL", insert -- SYMMETRY --.

Signed and Sealed this

Fifth Day of July, 1988

*Attest:*

*Attesting Officer*

DONALD J. QUIGG

*Commissioner of Patents and Trademarks*